United States Patent [19]

Thompson et al.

[11] 4,163,327

[45] Aug. 7, 1979

[54] DIRECT CONDENSER DEFROSTING SYSTEM

[75] Inventors: Taylor N. Thompson; Douglas S. Fraser, both of New Paltz, N.Y.

[73] Assignee: FTS Systems, Inc., Stone Ridge, N.Y.

[21] Appl. No.: 848,497

[22] Filed: Nov. 4, 1977

[51] Int. Cl.[2] ..... F26B 5/06

[52] U.S. Cl. ..... 34/5; 34/92

[58] Field of Search ..... 34/32, 5, 92

[56] References Cited

U.S. PATENT DOCUMENTS

| | | | |
|---|---|---|---|
| 2,687,626 | 8/1954 | Bartlowe | 62/126 |
| 2,726,515 | 12/1955 | Kleist | 62/126 |
| 2,758,150 | 8/1956 | Zargarpur | 174/84 |
| 2,777,300 | 1/1957 | Palmer | 62/126 |
| 2,819,858 | 1/1958 | Mittendorf | 284/54 |
| 3,029,610 | 4/1962 | Armentrout | 62/156 |
| 3,195,320 | 7/1965 | Kita | 62/276 |
| 3,247,600 | 4/1966 | Togashi et al. | 34/92 |
| 3,909,957 | 10/1975 | Passey | 34/92 |
| 4,081,914 | 4/1978 | Rautenbach | 34/92 |

*Primary Examiner*—Benjamin R. Padgett
*Assistant Examiner*—J. L. Barr
*Attorney, Agent, or Firm*—Robert E. Wagner; Thomas L. Kautz

[57] ABSTRACT

An improved defrosting means for a condenser in a freeze drying apparatus including a thermocouple for monitoring the condenser temperature during a freeze drying cycle, and an electric cartridge heater for defrosting the condenser after the freeze drying process, both of which are insertable into the structure of the condenser. The cartridge heater, in association with a highly-conductive woven mesh disposed in the interior of the condenser, provides for a uniform distribution of thermal energy throughout the condenser to quickly and efficiently cause layers of ice and frost on the outer surfaces of the condenser to break up and drop away.

9 Claims, 5 Drawing Figures

DIRECT CONDENSER DEFROSTING SYSTEM

BACKGROUND OF THE INVENTION

This invention relates to a system for defrosting a condenser used in freeze drying devices, and more particularly, to an electric defrost means insertable into the structure of a condenser for the removal of frost and ice accumulated on its outer surface during the operation of an associated freeze dryer.

The well-known process of freeze drying has provided an efficient technique for the dehydration of a wide variety of products, producing an end product virtually identical to the original material minus its water content. Briefly, four conditions must be obtained to accomplish proper freeze drying; the product to be dehydrated must be solidly frozen, a heat source must be employed to provide the heat of sublimation necessary to drive the water content of the material directly from its solid state to the vapor state, a condensing surface is required and, finally, the system must be provided with a vacuum.

The present invention involves the condenser portion of a freeze dryer, which provides the surface on which the water content of the material released by sublimation is condensed in the form of frost or ice. Once the material to be dried has been completely dehydrated, the condenser is covered with a layer of ice or frost which must be removed before another freeze drying run can be conducted. The present invention provides a unique means of defrosting the condenser, which solves several of the problems associated with prior art attempts to accomplish this result.

In the past, defrosting the condenser has been accomplished by a variety of means, including placing electric heaters on the outside of the condenser, blowing hot air over the ice on the surface of the condenser, reversing the refrigeration cycle in the material flowing through coils around the condenser, or simply allowing the ambient heat in the air to melt the ice away.

Defrosting of commercial refrigeration systems, including refrigerators and freezers, has been accomplished by techniques such as disclosed in U.S. Pat. No. 2,755,371 (Jackson). In Jackson, heating units are inserted into tubes disposed within selected bends in the coils of the refrigeration system, to remove accumulations of ice on the coils. This system of defrosting is not acceptable for use with condensers in freeze drying systems, however, since the efficient transfer of thermal energy between the heating means and the outer surface of the coils is accomplished only if the coils are completely filled with refrigerant fluid. As discussed below, it is undesirable, both in terms of cost and efficiency, to flood the condenser with refrigerant fluid during either the freeze drying or defrosting process.

The primary consideration in the defrosting devices or methods mentioned above is to accomplish the removal of ice and frost from the condenser as quickly as possible. In the past, it was thought that rusting and corrosion of the condenser could be avoided if the condensate was completely removed and the condenser surface cleaned and dried directly after defrosting. However, it has been found that corrosion and rusting begin shortly after the defrost cycle begins, even though a physical examination of the condenser shows only the collected ice to be present on the surfaces. The problem occurs under the surface, where a fluid interface exists between the condenser and the ice layers, which actively rusts the condenser until the outer ice layers break up and fall away. This is particularly a problem where corrosive materials, having a relatively high acidic or alkaline content, are dried. It is readily apparent that if the fluid interface between an ice layer and the condenser consisted primarily of a corrosive acid or base, the surface of the condenser would deteriorate quickly unless the outer ice layers were quickly broken away. Many of the prior methods of defrosting condensers mentioned above do not remove the ice or frost quickly enough to significantly reduce such rusting and corrosion of the condenser.

Another problem associated with prior art defrosters, particularly the hot air blowers and the electric heaters placed on the outside of the condenser, is that such devices tend to raise the temperature of surrounding portions of the freeze dryer adjacent to the condenser, especially the manifold in which the condenser is housed. As mentioned above, a requisite of freeze drying is the provision of a controlled heat input to provide the appropriate heat of sublimation to the frozen material undergoing drying. By raising the temperature of the elements of the dryer near the condenser and the receptacles containing frozen material to be dried, the turn-around time required before subsequent freeze drying runs may be made is lengthened by the time it takes such heated areas of the dryer to cool down to ambient temperatures. In addition, blowers and electric heaters are much more expensive to purchase and operate than the defrosting means of the present invention, while little or no increase in efficiency of operation is provided over the present invention, as discussed below.

SUMMARY OF THE INVENTION

Accordingly, the present invention provides a fast and efficient means of defrosting the condenser, which eliminates the bulky and expensive heaters or blowers found in many prior art devices. In one embodiment, the present invention includes an electric cartridge heater which is insertable into a thermal well in the condenser, which well also receives a thermocouple for monitoring the condenser temperature during the freeze drying process. As discussed below, the cartridge heater provides for a uniform distribution of heat along the entire inner surface of the condenser to quickly and efficiently cause the outer layers of ice to drop away from the condenser. The source of heat is applied directly inside of the condenser, where a highly-conductive mesh conducts and radiates the thermal energy to its inner surfaces. As a result, the temperature of the surrounding elements of the freeze dryer is not significantly affected, the heat being applied locally to the condenser, rather than to the entire area of the dryer occupied by the condenser, as was the case with certain prior art devices.

Therefore, it is an object of this invention to provide a condenser formed with a well to receive a thermocouple during the freeze drying operation, and a cartridge heater during the defrosting process.

It is a further object of this invention to provide a cartridge heater insertable into a well within a condenser, which, in association with a highly thermally-conductive mesh, heats the inner surfaces of the condenser, causing the ice or frost on the condenser surface to quickly drop off during the defrosting process.

It is another object of this invention to provide a condenser having a thermal well in which a thermocouple and cartridge heater may be removably inserted while maintaining the fluid-tight seal at the entrance to the well.

It is a still further object of the present invention to provide a condenser formed with two wells approximately 180° apart, one of which receives a thermocouple and the other a cartridge heater, for monitoring the temperature of the condenser during a freeze drying cycle and for defrosting the condenser thereafter.

DESCRIPTION OF THE DRAWINGS

Objects in addition to those specifically set forth will become apparent from reference to the accompanying drawings and following description, wherein.

DETAILED DESCRIPTION OF THE INVENTION

Figure 1:
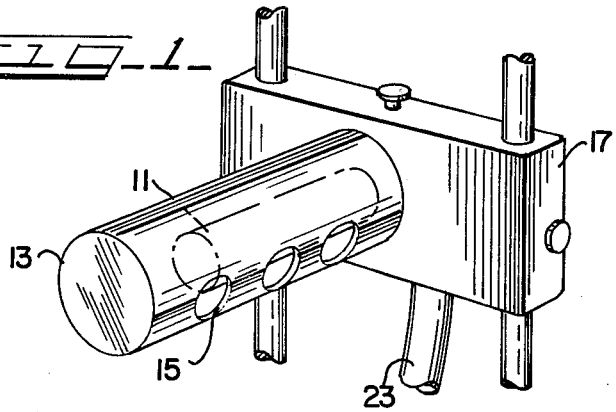
FIG. 1 is an over-all perspective view of a portion of a freeze dryer including the manifold which houses the condenser, and is formed with a plurality of ports for receiving the open end of receptacles containing materials to be freeze dried.

Referring now to the drawings, and in particular to FIG. 1, the condenser 11 of the present invention is shown in connection with associated elements of a commercially available freeze dryer, manufactured by FTS Systems, Inc. of Stone Ridge, N.Y. under U.S. Pat. No. 4,017,983. The condenser 11 is housed by a manifold 13, which is formed with a plurality of ports 15 for receiving receptacles containing material to be freeze dried (not shown). The manifold 13 is mounted to a hollow support post 17 which, in turn, is mounted to the cabinet of the freeze dryer.

Figure 3:
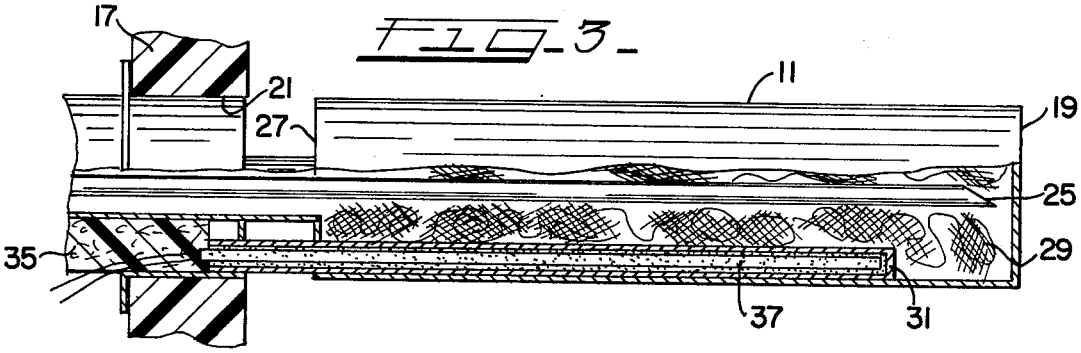
FIG. 3 is an enlarged cross-sectional view of the condenser of the present invention showing the thermal well disposed along the lower edge, a vacuum return line concentric with the condenser, and a portion of the thermally-conductive mesh disposed within the condenser.
Figure 5:
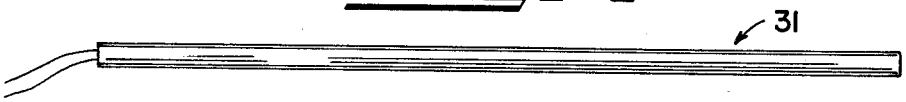

Referring now to FIG. 1, as well as to FIG. 3, it is seen that the condenser 11 is a generally cylindrical hollow tube which is mounted in fluid-tight contact with post 17 and concentrically within manifold 13. The condenser 11 is preferably made of a material such as stainless steel because of its corrosion resistance, durability and moderate cost. While it would be preferable if the condenser could be formed entirely of copper or be a solid copper rod for purposes of improved thermal conductivity, copper has proven to be unacceptable for use as a condenser because of susceptibility to corrosion and also toxicity to biological materials. The condenser tube 11 is formed with a proximal end 21 and a closed, distal end 19. The proximal end 21 of condenser 11 receives a flexible suction conduit 23, within which a refrigeration supply line 25 of smaller diameter is disposed. Supply line 25 injects a suitable refrigerant fluid into the condenser 11 at its distal end 19, which is provided by the refrigeration system of the freeze dryer. As is well known, the refrigerant fluid enters condenser 11 at a temperature lower than the frozen material to be freeze dried so that the water vapor sublimated from such materials will condense on the outer surface of the condenser 11. A radially extending baffle 27 is provided over the open, proximal end 21 of the condenser 11 to support suction conduit 23 and also to prevent the escape of refrigerant fluid from condenser 11.

Between the distal end 19 and the baffle 27, the condenser 11 is packed with a woven copper mesh 29, or any other suitable highly thermally-conductive material having a plurality of randomly disposed surfaces. The thermally-conductive surfaces of the mesh 29 in effect enlarge the surface area of the refrigerant fluid within the condenser 11, as the mesh 29 is wetted by the fluid. This mesh is described in U.S. Pat. No. 4,017,983, assigned to the same assignee as the present application. At the same time, the mesh 29 acts as a wick to conduct the refrigerant fluid throughout the condenser 11 and toward the surface of the condenser tube 11 to create a uniform temperature throughout. The mesh 29 thus achieves the advantages of optimum cooling temperatures within the condenser 11, which would normally only be possible by either flooding the hollow condenser with refrigerant fluid or using a solid copper rod. As discussed above, use of a solid copper rod in unacceptable because of corrosiveness and toxicity to biological materials, and flooding the condenser with refrigerant fluid is costly and inefficient.

The flow of the refrigerant fluid begins at the supply line 25 near the distal end 19 of the condenser 11, and moves toward the proximal end 21 of the condenser 11 to promote a uniform temperature throughout. As the condenser 11 becomes colder, the compressor of the freeze dryer's refrigeration system (not shown) to which the free end of conduit 23 is attached, begins to pump a part liquid, part vapor phase form of refrigerant into the condenser 11. Without the mesh 29, the liquid refrigerant would tend to stand in a puddle at the bottom portion of the condenser 11, presenting only a minimal surface area to be evaporated during sublimation of the material undergoing drying. However, the refrigerant is distributed over the surfaces of the mesh 29 through capillary action and its own thermal conductance, to expand the area available for thermal energy transfer by evaporation of fluid and to allow more refrigerant to be contained within the condenser 11.

As mentioned above, a major problem with prior art defrosting devices is their inability to quickly and efficiently remove the outer layer of ice from the condenser, without, in some cases, raising the temperature of elements of the freeze dryer adjacent to the condenser. The defrosting means of the present invention applies the heat required to defrost the condenser locally, as discussed below, and also fully utilizes the improved thermal conductivity within the condenser 11 provided by the copper mesh 29.

Figure 2:
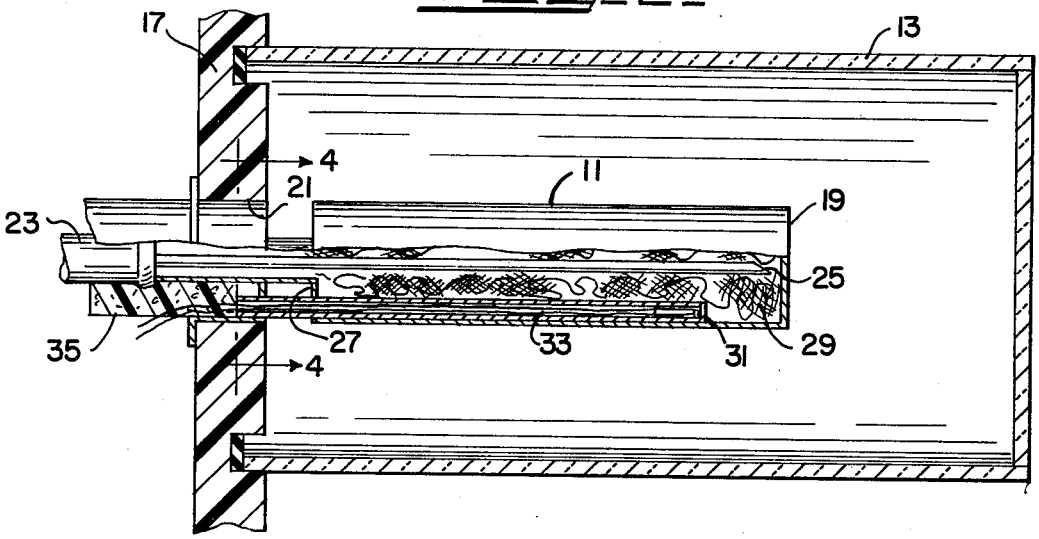
FIG. 2 is a cross-sectional view of a manifold and the condenser housed therein, showing a partial cut-away view into the interior of the condenser.

Referring now to the embodiment shown in FIGS. 2 and 3, the condenser 11 had a cylindrical thermal well 31 formed from tubing closed at one end, brazed to its interior bottom surface and extending from the proximal end 21 of the condenser 11 to a point adjacent the distal end 19. The well 31 serves a valuable function both in the freeze drying cycle and in the defrosting process. During the freeze drying process, it is desirable to monitor the temperature of the condenser 11 to insure that the sublimation of water vapor from the freeze drying materials to the surface of the condenser 11 is proceeding efficiently. Accordingly, a thermocouple 33 is inserted into the well 31 to monitor the temperature of the condenser 11 as the freeze drying process progresses. The thermocouple 33 is inserted into the well 31 by first temporarily withdrawing a section of soft rubber insulation 35 from the proximal end 21 of the condenser 11, which insulation 35 provides a fluid-tight joint between the manifold 13 and condenser 11. A highly conductive heat sink paste, such as magnesium oxide, is dabbed on the end of the thermocouple 33 and then inserted into the well 31. The heat sink paste allows the sensing end of the thermocouple 33 to make contact with the well 31 for efficient thermal conductivity therebetween and also eliminates any pockets of air in well 31. The water vapor in such air pockets could form crystals of ice during the freeze drying process which could contact the thermocouple 33 and affect the accuracy of the temperature reading. Insulation 35 is then replaced before freeze drying is begun.

Once the freeze drying run has been completed, the rubber insulation 35 is again pulled away, and the thermocouple 33 is removed. The defrosting cycle is initiated by inserting a cartridge heater 37, coated with the same heat sink paste, into the thermal well 31 of condenser 11 and then replacing rubber insulation 35. Once the freeze drying process is completed, the refrigeration system is shut down, stopping the circulation of refrigerant fluid from the distal end 19 of the condenser 11 to the suction conduit 23. As the condenser 11 begins to warm up, the refrigerant leaves the vapor phase and becomes a liquid which drips down from the copper mesh 29 to a puddle at the bottom of the condenser 11 around the thermal well 31. When the cartridge heater 37 is energized, the refrigerant fluid is quickly boiled into a hot vapor, which is distributed over the mesh surfaces. As discussed above, the highly thermally-conductive surfaces of the mesh 29 effectively increase the surface area of the hot fluid vapor, and act as a wick to conduct the hot vapor throughout the condenser 11 and toward the surfaces of the condenser 11 to create a uniform temperature throughout. Accordingly, the inner surfaces of condenser 11 are rapidly and uniformly heated, by direct application of thermal energy even though the source is located in only a relatively localized area of the condenser 11. The mesh 29 efficiently distributes the heat throughout the condenser 11 and causes the ice around the outer surfaces to quickly break up and fall away, thus limiting rusting and corrosion. Since cartridge heater 37 applies the heat in such a localized area within condenser 11, the temperatures of the surrounding elements of the freeze dryer, such as manifold 13, are not significantly affected. Therefore, the turn-around time in which a subsequent run may be conducted is greatly lessened by the present invention, since surrounding elements of the freeze dryer remain near ambient temperatures.

Figure 4:
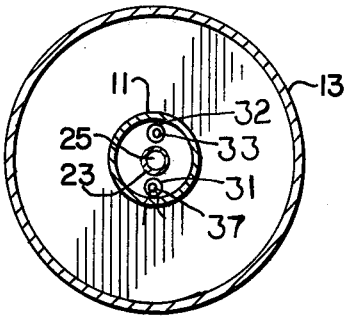
FIG. 4 is a cross-sectional end view of an alternate embodiment of the condenser of the present invention, taken generally as shown along line 4—4 of FIG. 2, depicting a pair of thermal wells disposed at 180° from one another in the interior walls of the condenser; and, FIG. 5 is an enlarged elevational view of the thermal well apart from the condenser.

An alternate embodiment of the present invention is shown in FIG. 4, wherein a second well 32 is brazed into the condenser 11 at approximately 180° from well 31. In this embodiment, the cartridge heater 37 is placed in well 31, and the thermocouple 33 is inserted into well 32 for the duration of both the freeze drying and defrosting processes. This eliminates the necessity of alternately removing the thermocouple 33 and cartridge heater 37 from the well 31 during the defrosting and freeze drying cycles, respectively, as was required in the embodiment of FIGS. 2 and 3. When the freeze drying cycle is completed herein, the cartridge heater 37 is energized by simply flipping a switch and the defrosting cycle begins immediately without first removing insulation 35 and withdrawing thermocouple 33, as described above.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. In a freeze drying apparatus for dehydrating heat-sensitive materials contained in a plurality of receptacles, including refrigeration means to provide refrigerant fluid of a temperature lower than the temperature of the material to be freeze dried, manifold means having a plurality of ports formed therein to which said receptacles may be connected, and an elongated hollow condenser member disposed within the interior of said manifold means and receiving low temperature refrigerant fluid from said refrigeration means during a freeze drying cycle, the water vapor sublimated from said materials being condensed on the outer surfaces of said condenser member to form ice, the improvement comprising:

a plurality of randomly disposed heat transfer surfaces disposed within the interior of said condenser member;

an elongated conduit disposed within the interior of said condenser member adjacent an interior surface thereof;

heat sensing means removably insertable into said conduit and in thermal communication therewith for monitoring the temperature of said condenser member during said freeze drying cycle; and, heating means alternately removably insertable into said conduit and in thermal communication therewith for defrosting said condenser means at the completion of said freeze drying cycle, said heating means being operable to provide thermal energy and vaporizing said refrigerant fluid within said condenser, said thermal energy being transferred by said refrigerant fluid to said randomly disposed heat transfer surfaces throughout the interior of said condenser member, whereby said refrigerant fluid and said randomly disposed heat transfer surfaces cooperate to quickly and uniformly increase the temperature of the surfaces of said condenser member to facilitate removal of the ice from the outer surfaces thereof while limiting the amount of thermal energy transferred to adjacent surfaces of the freeze dryer.

2. The apparatus of claim 1 wherein said heat sensing means includes a thermocouple, said thermocouple being covered with a thermally-conductive paste material at the heat sensitive end, said material allowing said thermocouple to communicate with said conduit for thermal conductivity therebetween, said thermocouple monitoring the temperature of said conduit and said condenser during a freeze drying cycle.

3. The apparatus of claim 1 wherein said heating means includes a cartridge heater insertable within said conduit, said cartridge heater being covered with a thermally-conductive paste material, said paste material allowing said cartridge heater to communicate with said conduit for transfer of thermal energy therebetween during a defrosting cycle.

4. The apparatus of claim 1 wherein said elongated hollow conduit is a brazed well formed in said hollow member for removably receiving said heat sensing means and said heating means.

5. An apparatus for sensing the temperature with a hollow condenser of a freeze drying system and for defrosting product ice accumulated on the outer surfaces of said condenser, including:

an elongated thermal well disposed within the interior of said condenser and adjacent an interior surface thereof;

a plurality of randomly disposed thermally conductive surfaces disposed within the interior of said condenser;

a thermocouple removably insertable within said well and in thermal communication therewith for monitoring the condenser temperature during the freeze drying process; and an electric cartridge heater alternately removably insertable into said well and in thermal communication therewith, said cartridge heater being operable to cause, in association with said thermally conductive surfaces, a uniform increase in the temperature of said condenser to facilitate removal of said product ice formed on the outer surfaces of said condenser after completion of the freeze drying process.

6. In a freeze-drying apparatus, a method of sensing condenser temperature during freeze drying and thereafter defrosting product ice from said condenser, said condenser having a thermal well formed therein, the method comprising:

inserting a thermocouple into said well in thermal communication therewith for monitoring condenser temperature during a freeze-drying process, removing said thermocouple from said well upon completion of said freeze-drying process, inserting an electric cartridge heater into said well and in thermal communication therewith, energizing said cartridge heater for increasing the temperature throughout the interior surfaces of said condenser, and cleaning the outer surfaces of said condenser as said product ice falls away from said condenser.

7. The method of claim 6 further including the step of applying a highly thermally conductive paste material to the sensing end of said thermocouple before insertion into said well for allowing said thermocouple to communicate with said well for transfer of thermal energy therebetween during said freeze-drying process.

8. The method of claim 6 further including the step of applying a highly thermally conductive paste material along the length of said cartridge heater before insertion into said well for allowing said cartridge heater to communicate with said well for transfer of thermal energy therebetween during said defrosting process.

9. In a freeze drying apparatus for dehydrating heat-sensitive materials contained in a plurality of receptacles, including refrigeration means to provide refrigerant fluid of a temperature lower than the temperature of the material to be freeze dried, manifold means having a plurality of ports formed therein to which said receptacles may be connected, and an elongated hollow condenser member disposed within the interior of said manifold means and receiving low temperature refrigerant fluid from said refrigerant means during a freeze drying cycle, the water vapor sublimated from said materials being condensed on the outer surfaces of said condenser member to form ice, the improvement comprising:

a plurality of randomly disposed heat transfer surfaces disposed within the interior of said condenser member;

an elongated first conduit disposed within the interior of said condenser member adjacent an interior surface thereof;

heat sensing means removably insertable into said first conduit and in thermal communication therewith for monitoring the temperature of said condenser member during said freeze drying cycle;

an elongated second conduit disposed within the interior of said condenser member adjacemt an interior surface of said condenser member opposite said first conduit; and, heating means insertable into said second conduit and in thermal communication therewith for defrosting said condenser member at the completion of said freeze drying cycle, said heating means being operable to provide thermal energy for heating and vaporizing refrigerant fluid within said condenser member, said thermal energy being transferred by said refrigerant fluid to said randomly disposed heat transfer surfaces throughout the interior of said condenser member, whereby said refrigerant fluid and said randomly disposed heat transfer surfaces cooperate to quickly and uniformly increase the temperature of the surfaces of said condenser member to facilitate removal of the ice from the outer surfaces thereof while limiting the amount of thermal energy transferred to adjacent surfaces of the freeze dryer.

* * * * *